US011525606B2

(12) United States Patent
Tarbell et al.

(10) Patent No.: US 11,525,606 B2
(45) Date of Patent: Dec. 13, 2022

(54) FLOATING EVAPORATOR SATURATED SUCTION TEMPERATURE SYSTEMS AND METHODS

(71) Applicant: Emerson Digital Cold Chain, Inc., Kennesaw, GA (US)

(72) Inventors: Christopher A. Tarbell, Marietta, GA (US); Gregory S. Mickelson, Acworth, GA (US); Christopher R. Denney, Bentonville, AR (US)

(73) Assignee: Emerson Digital Cold Chain, Inc., Kennesaw, GA (US)

( * ) Notice: Subject to any disclaimer, the term of this patent is extended or adjusted under 35 U.S.C. 154(b) by 0 days.

(21) Appl. No.: 17/031,980

(22) Filed: Sep. 25, 2020

(65) Prior Publication Data

US 2021/0095898 A1 Apr. 1, 2021

Related U.S. Application Data

(60) Provisional application No. 62/907,286, filed on Sep. 27, 2019.

(51) Int. Cl.

| | |
|---|---|
| ***F25B 49/02*** | (2006.01) |
| ***F25B 5/02*** | (2006.01) |
| ***F25B 41/22*** | (2021.01) |

(52) U.S. Cl.

CPC ..... *F25B 5/02* (2013.01); *F25B 41/22* (2021.01); *F25B 49/02* (2013.01); *F25B 2700/1933* (2013.01); *F25B 2700/21173* (2013.01)

(58) Field of Classification Search

CPC .. F25B 5/02; F25B 41/22; F25B 49/02; F25B 2700/1933; F25B 2700/21173

See application file for complete search history.

(56) References Cited

U.S. PATENT DOCUMENTS

| | | | | |
|---|---|---|---|---|
| 5,867,995 | A * | 2/1999 | Lewis | F25B 41/22 62/115 |
| 7,287,396 | B2 | 10/2007 | Maier et al. | |
| 2015/0068238 | A1 * | 3/2015 | Haikawa | F24F 1/0063 62/222 |

FOREIGN PATENT DOCUMENTS

| | | | | |
|---|---|---|---|---|
| WO | WO-2020208805 | A1 * | 10/2020 | F25B 1/00 |

OTHER PUBLICATIONS

Hiroaki, Air-conditioning device, 2019, Full Document (Year: 2019).*

* cited by examiner

*Primary Examiner* — Nael N Babaa

(74) *Attorney, Agent, or Firm* — Harness, Dickey & Pierce, P.L.C.

(57) ABSTRACT

Systems and methods are provided and include a case controller for a refrigeration case of a refrigeration system. The case controller is configured to: determine an evaporator saturated suction temperature (SST) of an evaporator of the refrigeration case; control an evaporator pressure regulator of the refrigeration system based on a comparison of the evaporator SST with an evaporator saturated suction temperature (SST) setpoint; receive an air temperature value from an air temperature sensor associated with the refrigeration case; determine whether the air temperature value is within a predetermined range of an air temperature setpoint; and adjust the SST setpoint in response to the air temperature value being outside of the predetermined range of the air temperature setpoint.

20 Claims, 7 Drawing Sheets

Process Overview

Performing Floating Setpoint Control (208)

Calculating Float Adjustment (308)

Calculating Adjustment Amount (408)

Adjusting Control Output (212)

FLOATING EVAPORATOR SATURATED SUCTION TEMPERATURE SYSTEMS AND METHODS

CROSS-REFERENCE TO RELATED APPLICATIONS

This application claims the benefit of U.S. Provisional Application No. 62/907,286, filed on Sep. 27, 2019. The entire disclosure of the above application is incorporated herein by reference.

FIELD

The present disclosure relates to control systems and methods for determining an optimal evaporator saturated suction temperature setpoint (SST) for an evaporator and controlling an evaporator pressure regulating valve based on the determined evaporator saturated suction temperature setpoint, with the optimal evaporator SST being an evaporator SST that will result in a control value of the evaporator, such as discharge air temperature (DAT), being closer to a control value setpoint, such as a DAT setpoint.

BACKGROUND

This section provides background information related to the present disclosure which is not necessarily prior art.

The temperature within a refrigerated space, such as within a refrigeration case of a supermarket refrigeration system, can be controlled by controlling evaporator suction pressure. For example, discharge air temperature of the evaporator can be monitored and a position of an electronic evaporator pressure regulating valve (EEPR) can be controlled based on a discharge air temperature setpoint. When the discharge air temperature is above the setpoint, an opening of the EEPR can be increased to decrease the evaporator pressure and lower the discharge air temperature of the evaporator. When the discharge air temperature is below the setpoint, the opening of the EEPR can be decreased to increase the evaporator pressure and increase the discharge air temperature of the evaporator. Alternatively, evaporator pressure can be monitored and the EEPR can be controlled based on a fixed evaporator pressure setpoint. For example, U.S. Pat. No. 7,287,396, titled "Evaporator Pressure Regulator Control and Diagnostics," describes a controller that controls an associated electronic evaporator pressure regulator of an evaporator. U.S. Pat. No. 7,287,396 is incorporated by reference in its entirety.

Traditional control systems and methods, however, may not account for external factors, such dirty coils or degradation of superheat control, that may impact the ability of the system to accurately and efficiently satisfy the cooling demand within the refrigerated space. The use of zeotropic refrigerant mixtures that have a high evaporator temperature glide may also impact the ability of the traditional control systems and methods to accurately and efficiently satisfy the cooling demand within the refrigerated space. Further, traditional systems may periodically require manual tuning and adjustment by a technician.

SUMMARY

This section provides a general summary of the disclosure, and is not a comprehensive disclosure of its full scope or all of its features.

The present disclosure provides a system that includes a case controller for a refrigeration case of a refrigeration system. The case controller is configured to determine an evaporator saturated suction temperature (SST) of an evaporator of the refrigeration case, control an evaporator pressure regulator of the refrigeration system based on a comparison of the evaporator SST with an evaporator saturated suction temperature (SST) setpoint, receive an air temperature value from an air temperature sensor associated with the refrigeration case, determine whether the air temperature value is within a predetermined range of an air temperature setpoint, and adjust the SST setpoint in response to the air temperature value being outside of the predetermined range of the air temperature setpoint.

In other features, the case controller can be further configured to increase the SST setpoint in response to the air temperature value being outside of the predetermined range and below the air temperature setpoint and to decrease the SST setpoint in response to the air temperature value being outside of the predetermined range and above the air temperature setpoint.

In other features, the air temperature sensor can monitor at least one of a discharge air temperature (DAT) value and a return air temperature (RAT) value of the evaporator and can communicate the at least one of the DAT value and the RAT value to the case controller as the air temperature value.

In other features, the case controller can be further configured to adjust the SST setpoint a maximum of one time during each of consecutive predetermined time interval cycles based on an adjustment amount.

In other features, the adjustment amount can be user configurable.

In other features, the case controller can be further configured to receive an evaporator suction pressure from an evaporator suction pressure sensor associated with the evaporator, determine the evaporator SST of the evaporator based on the evaporator suction pressure, compare the evaporator SST with the evaporator SST setpoint, and control the evaporator pressure regulator based on the comparison of the evaporator SST with the evaporator SST setpoint.

In other features, the case controller can be further configured to increase an opening of the evaporator pressure regulator when the evaporator SST is greater than the evaporator SST setpoint and to decrease the opening of the evaporator pressure regulator when the evaporator SST is less than the evaporator SST setpoint.

In other features, the evaporator pressure regulator can be an electronic evaporator pressure regulator.

The present disclosure also provides a method that includes determining, with a case controller for a refrigeration case of a refrigeration system, an evaporator saturated suction temperature (SST) of an evaporator of the refrigeration case. The method also includes controlling, with the case controller, an evaporator pressure regulator of the refrigeration system based on a comparison of the evaporator SST with an evaporator saturated suction temperature (SST) setpoint. The method also includes receiving, with the case controller, an air temperature value from an air temperature sensor associated with the refrigeration case. The method also includes determining, with the case controller, whether the air temperature value is within a predetermined range of an air temperature setpoint. The method also includes adjusting, with the case controller, the SST setpoint in response to the air temperature value being outside of the predetermined range of the air temperature setpoint.

In other features, the method can also include increasing, with the case controller, the SST setpoint in response to the air temperature value being outside of the predetermined range and below the air temperature setpoint, and decreasing, with the case controller, the SST setpoint in response to the air temperature value being outside of the predetermined range and above the air temperature setpoint.

In other features, the method can also include the air temperature sensor can monitor at least one of a discharge air temperature (DAT) value and a return air temperature (RAT) value of the evaporator and communicate the at least one of the DAT value and the RAT value to the case controller as the air temperature value.

In other features, the method can also include adjusting, with the case controller, the SST setpoint a maximum of one time during each of consecutive predetermined time interval cycles based on an adjustment amount.

In other features, the adjustment amount can be user configurable.

In other features, the method can also include receiving, with the case controller, an evaporator suction pressure from an evaporator suction pressure sensor associated with the evaporator, determining, with the case controller, an evaporator SST of the evaporator based on the evaporator suction pressure, comparing, with the case controller, the evaporator SST with the evaporator SST setpoint, and controlling, with the case controller, the evaporator pressure regulator based on the comparison of the evaporator SST with the evaporator SST setpoint.

In other features, the method can also include increasing, with the case controller, an opening of the evaporator pressure regulator when the evaporator SST is greater than the evaporator SST setpoint, and decreasing, with the case controller, the opening of the evaporator pressure regulator when the evaporator SST is less than the evaporator SST setpoint.

In other features, the evaporator pressure regulator can be an electronic evaporator pressure regulator.

The present disclosure also provides a system that includes a first case controller for a first refrigeration case having a first evaporator of at least one of a refrigeration system and an HVAC system and a second case controller for a second refrigeration case having a second evaporator of the at least one of the refrigeration system and the HVAC system. The first refrigeration case and the second refrigeration case discharge refrigerant to an evaporator pressure regulator of the refrigeration system. The first case controller is configured to receive a first air temperature value from a first air temperature sensor associated with the first refrigeration case and to communicate the first air temperature value to the second case controller. The second case controller is configured to: (i) receive a second air temperature value from a second air temperature; (ii) determine an evaporator saturated suction temperature (SST) value based on at least one a first evaporator SST of the first evaporator and a second evaporator SST of the second evaporator; (iii) control the evaporator pressure regulator of the refrigeration system based on a comparison of the evaporator SST value with an evaporator SST setpoint; (iv) determine an air temperature control value based on the first air temperature value and the second air temperature value; (v) determine whether the air temperature control value is within a predetermined range of an air temperature setpoint; and (vi) adjust the evaporator SST setpoint in response to the air temperature control value being outside of the predetermined range of the air temperature setpoint.

In other features, the second case controller can be further configured to determine the air temperature control value by averaging the first air temperature value and the second air temperature value.

In other features, the second case controller can be further configured to increase the SST setpoint in response to the air temperature control value being outside of the predetermined range and below the air temperature setpoint and to decrease the SST setpoint in response to the air temperature control value being outside of the predetermined range and above the air temperature setpoint.

In other features, the first case controller can be further configured to receive a first evaporator suction pressure from a first evaporator suction pressure sensor associated with the first evaporator and to communicate the first evaporator suction pressure to the second case controller. The second case controller can be further configured to: (i) receive a second evaporator suction pressure from a second evaporator suction pressure sensor associated with the second evaporator; (ii) determine the evaporator SST value based on the first evaporator suction pressure and the second evaporator suction pressure; (iii) compare the evaporator SST value with the evaporator SST setpoint; and (iv) control the evaporator pressure regulator based on the comparison of the evaporator SST value with the evaporator SST setpoint.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
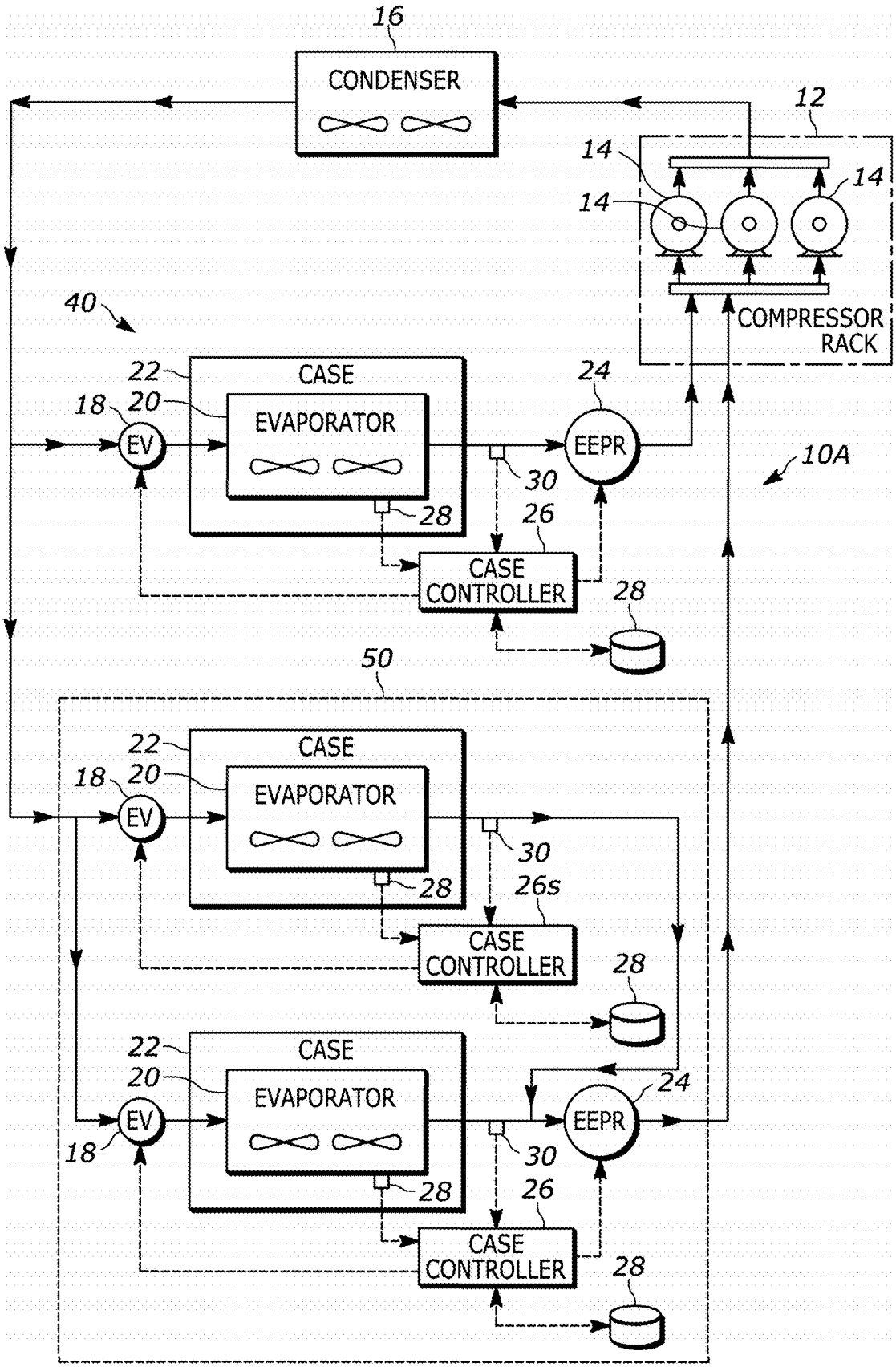
FIG. 1A is a block diagram of a refrigeration system in accordance with the present teachings.

Example embodiments will now be described more fully with reference to the accompanying drawings.

The present disclosure includes an evaporator pressure control algorithm that determines an optimal evaporator saturated suction temperature (SST) setpoint to produce a desired evaporator discharge air temperature. A setpoint adjustment amount is determined by the control algorithm and used to determine an optimal SST setpoint. The setpoint adjustment amount is stored in memory and used by the control algorithm when calculating the current setpoint.

Refrigeration equipment manufacturers generally provide a recommended setpoint for evaporator SST. That recommended setpoint is received as input to the algorithm and used as a base or initial predetermined SST setpoint for the evaporator. The control algorithm then operates the system and controls an electronic evaporator pressure regulating (EEPR) valve using the initial predetermined SST setpoint for an initial period of time to collect an initial dataset of evaporator air temperature data points during the initial period of time, such as discharge air temperature (DAT), return air temperature (RAT), or a combination of DAT and RAT. The temperature data is then averaged over a period of time to smooth out isolated spikes. While the present disclosure provides examples utilizing DAT as the control value, it is understood that the systems and methods of the present disclosures can utilize DAT, RAT, or a combination of DAT and RAT as the control value.

Once a sufficient amount of data has been collected over the initial time period, the control algorithm enables a floating algorithm that floats or adjusts the SST setpoint. For example, the control algorithm determines whether the evaporator DAT or RAT is within an acceptable temperature band surrounding a temperature setpoint. The control algorithm compares the current temperature value of the evaporator with the temperature band to determine whether the temperature is too warm or too cold. When the current temperature is outside of the acceptable temperature band, the control algorithm automatically makes incremental adjustments to the evaporator SST setpoint to increase or decrease the evaporator SST setpoint. After an SST setpoint adjustment, the control algorithm activates an interval timer. Once the interval timer expires, evaporator temperature data is re-evaluated and, if the temperature data remains outside of the acceptable temperature band, then another adjustment is made to the evaporator SST setpoint. Once the temperature remains within the acceptable temperature band, a satisfactory SST setpoint has been achieved and the control algorithm refrains from making additional SST setpoint adjustments until the evaporator temperature falls outside of the acceptable temperature band again. The optimal SST setpoint is then stored in memory.

One beneficial feature of the systems and methods of the present disclosure is provided during a refrigeration pull down after a defrost cycle. For example, when the system enters a refrigeration mode after a defrost cycle, the control algorithm loads the previously stored optimal SST setpoint that was determined and used prior to starting that defrost cycle. This reduces the amount of time required to bring the evaporator temperature and product temperature back down to the target temperature in the refrigerated space. A beneficial feature of the systems and methods of the present disclosure, as compared with existing systems and methods, is that during a pulldown after a defrost cycle the control algorithm can disable the floating SST setpoint algorithm to allow sufficient time for the system to remove the inherent heat load generated by the defrost cycle. During this waiting time, the control algorithm does not attempt to make SST setpoint adjustments. If, however, the control algorithm detects that the pulldown is taking longer than a predetermined amount of time, such as 30 to 60 minutes, to cool the temperature of the evaporator to the target temperature, then the floating SST setpoint algorithm can be automatically re-enabled to attempt to pull the temperature down to target.

Figure 1B:
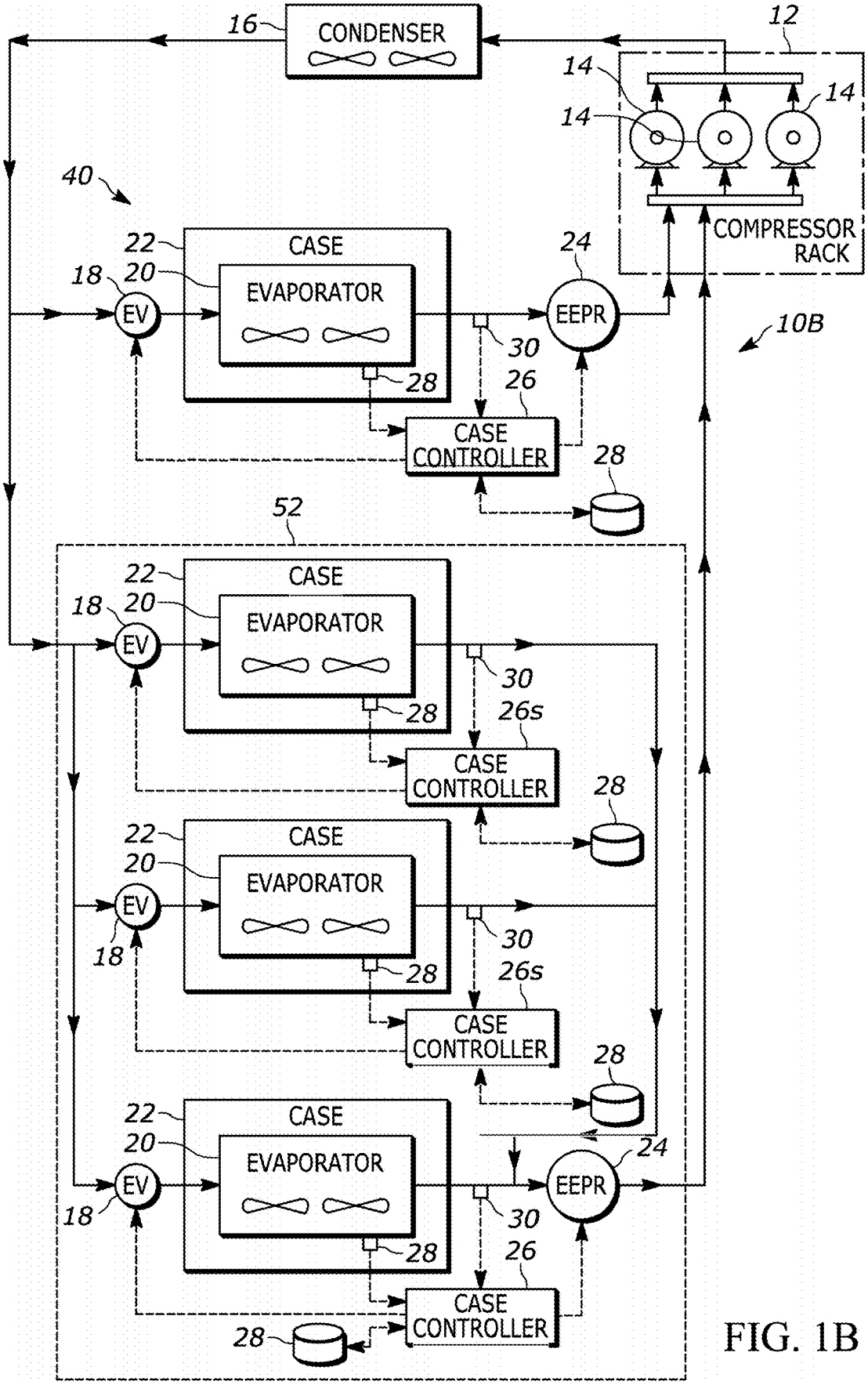
FIG. 1B is a block diagram of a refrigeration system in accordance with the present teachings.

With reference to FIGS. 1A and 1B, refrigeration systems 10A and 10B are shown. Refrigeration systems 10A and 10B are collectively referred to as 10. Each of the refrigeration systems 10 include two circuits. For example, refrigeration system 10A includes circuit 40 having a single refrigeration case and circuit 50 having a lineup of two refrigeration cases 22. FIG. 1B includes circuit 40 and a circuit 52 having a lineup of three refrigeration cases 22. While FIGS. 1A and 1B show circuits 50, 52 having a lineup of two and three refrigeration cases piped together, a refrigeration circuit in accordance with the present disclosure could include additional refrigeration cases. For example, a refrigeration circuit could include eight refrigeration cases. As shown in FIGS. 1A and 1B, each refrigeration case 22 includes a corresponding evaporator 20. The refrigeration system 10 can be installed, for example, in a supermarket in which the cases 22 can be used for different refrigeration temperature requirements. For example, one refrigeration case 22 can be used for frozen food while another refrigeration case 22 can be used for meat or dairy products. In addition, while the example of FIG. 1 is shown with a refrigeration system 10, the present teachings are also applicable to heating ventilation and air conditioning (HVAC) systems, such as air conditioning or heat pump systems. In addition, the present teachings are also applicable to other systems that include heat exchangers with suction pressure regulation, such as subcoolers.

The refrigeration system 10 also includes a compressor rack 12 with multiple compressors 14. While three compressors 14 are shown in FIGS. 1A and 1B, any number of compressors 14 can be used in accordance with the present teachings. Any of the compressors 14 can be, for example, fixed or variable-capacity compressors. The compressor rack 12 can include one or more variable-capacity compressors and one or more fixed-capacity compressors. Any of the compressors 14 can be scroll compressors, reciprocating compressors, rotary vane compressors, or any other suitable type of compressor. The compressors 14 in the compressor rack 12 can be connected via appropriate suction and discharge headers. The compressor rack 12 and the compressors 14 can be controlled by an associated rack controller or system controller that activates and deactivates compressors 14 within the compressor rack 12 and/or increases or decreases the capacity of any variable capacity compressors 12 to sufficiently meet the current refrigeration load on the refrigeration system 10

The compressors 14 receive low-pressure refrigerant vapor on a suction side of the compressors 14 via the suction header and compress the low-pressure refrigerant vapor into high-pressure refrigerant vapor that is discharged to the discharge header. The high-pressure refrigerant vapor is received by a condenser 16. The condenser 16, for example, can include one or more condenser fans that remove heat from the high-pressure refrigerant vapor so that the high-pressure refrigerant vapor condenses to liquid refrigerant. The condenser 16 discharges high-pressure, low-temperature refrigerant liquid.

The liquid refrigerant from the condenser 16 is routed to the evaporators 20 of each of the refrigeration cases 22. An expansion valve 18 associated with each of the evaporators 20 receives the liquid refrigerant and decreases the pressure of the refrigerant to discharge a low pressure liquid refrigerant to the associated evaporator 20. The expansion valves 18 can be thermostatic expansion valves (TXV), pulse type solenoids, electronic expansion valves (EXV), or any other suitable type of expansion valve.

The evaporators 20 include an evaporator coil and one or more fans that circulate air from within the refrigerated space, such as the interior of the refrigeration case 22, over the evaporator coil so that heat from the circulated air is absorbed by the refrigerant in the evaporator coil thereby cooling the circulated air within the refrigerated space. The heat absorbed by the refrigerant from the circulated air causes the liquid refrigerant to vaporize into refrigerant vapor. The refrigerant vapor discharged from the evaporator 20 is then routed back to a suction side and suction header of the compressor rack 12. The refrigeration cycle then starts anew.

Each of the circuits 40, 50, 52 includes an electronic evaporator pressure regulator (EEPR) valve 24 on a discharge side of the evaporators 20 between the evaporators 20 and the suction side of the compressor rack 12. In circuits 50, 52 with multiple refrigeration cases 22, a single EEPR valve 24 can be used for the multiple cases 22 such that refrigerant from each of the cases 22 is piped together before encountering the EEPR valve 24. An opening of the EEPR valve 24 is increased or decreased to control evaporator suction pressure for the evaporators 20 within the associated circuit 40, 50, 52. For example, increasing the opening of the EEPR valve 24 decreases the evaporator suction pressure and decreasing the opening of the EEPR valve 24 increases the evaporator suction pressure of the associated evaporator 20. While the examples of the present disclosure are described as utilizing an EEPR valve 24, any evaporator pressure regulator can be used with the present teachings.

Each of the refrigeration cases 22 has an associated case controller 26, 26*s*. In addition, each EEPR valve 24 is controlled by a corresponding master case controller 26. Other case controllers 26*s* in the same circuit 50, 52 as the master case controller 26 can communicate temperature data for the associated refrigeration cases 22 to the master case controller 26. For example, as discussed in further detail below, each of the case controllers 26, 26*s* receives evaporator suction pressure data from a suction pressure sensor 30. In addition, the master case controller 26 can receive suction pressure data from each of the slave case controllers 26*s* within the circuit 50, 52. As shown in FIGS. 1A and 1B, the suction pressure sensor 30 can be located near a discharge outlet of the evaporator and senses the pressure of the refrigerant exiting the evaporator 20 prior to encountering the EEPR valve 24. As discussed in further detail below, the case controller 26 determines a saturated suction temperature (SST) of the evaporator 20 based on the suction pressure data from the suction pressure sensor 30. The case controller 26 then compares the SST of the evaporator 20 with an SST setpoint and controls the EEPR valve 24 based on the comparison. The SST setpoint is stored in a memory 28 accessible to the case controller 26. For example, if the SST of the evaporator 20 is above the SST setpoint, the case controller 26 controls the EEPR valve 24 to increase an opening of the EEPR valve 24 and decrease the SST of the evaporator 20 towards the SST setpoint. Likewise, if the SST of the evaporator 20 is below the SST setpoint, the case controller 26 controls the EEPR valve 24 to decrease an opening of the EEPR valve 24 and increase the SST of the evaporator 20 towards the SST setpoint.

The case controller 26 also receives data indicating discharge air temperature (DAT) of the evaporator 20 from a DAT sensor 28 that senses the DAT of the evaporator 20. For circuits 50, 52 with multiple cases 22, the slave case controllers 26*s* can communicate DAT data for the corresponding cases to the master case controller 26 for the circuit 50, 52. As discussed in further detail below, the case controller 26 monitors the DAT of the evaporator 20 and compares the DAT of the evaporator 20 with a DAT setpoint stored in memory 28. As mentioned above, while examples are providing using DAT as the control variable, other temperatures can be used in accordance with the present disclosure. For example, return air temperature (RAT) can be used. Additionally, a combination of RAT and DAT can be used. As discussed in further detail below, the case controller 26 can float or adjust the SST setpoint based on the comparison of the DAT setpoint with the sensed DAT of the evaporator 20. In particular, as discussed in further detail below, if the current DAT of the evaporator 20 is too low, the case controller 26 can increase the SST setpoint to incrementally raise the SST and the DAT of the evaporator 20. Likewise, if the current DAT of the evaporator 20 is too high, the case controller 26 can decrease the SST setpoint to incrementally lower the SST and the DAT of the evaporator 20.

As noted below, the case controller 26 includes one or more processors, modules, and/or circuitry, such as one or more printed circuit board (PCBs), configured to implement and perform the functionality of the present disclosure, described in further detail below. For example, the case controller 26 can include a processor configured to execute computer-executable instructions stored in memory to carry out and perform the functionality and methods of the present disclosure. Additionally, while the examples of the present disclosure describe the functionality and methods as being performed by the case controller 26, the functionality and methods can alternatively be performed by a system controller and/or by a remote computer that receives the sensed data from the DAT sensor 28 and the pressure sensor 30 and that is in communication with and controls the EEPR valve 24.

Figure 2:
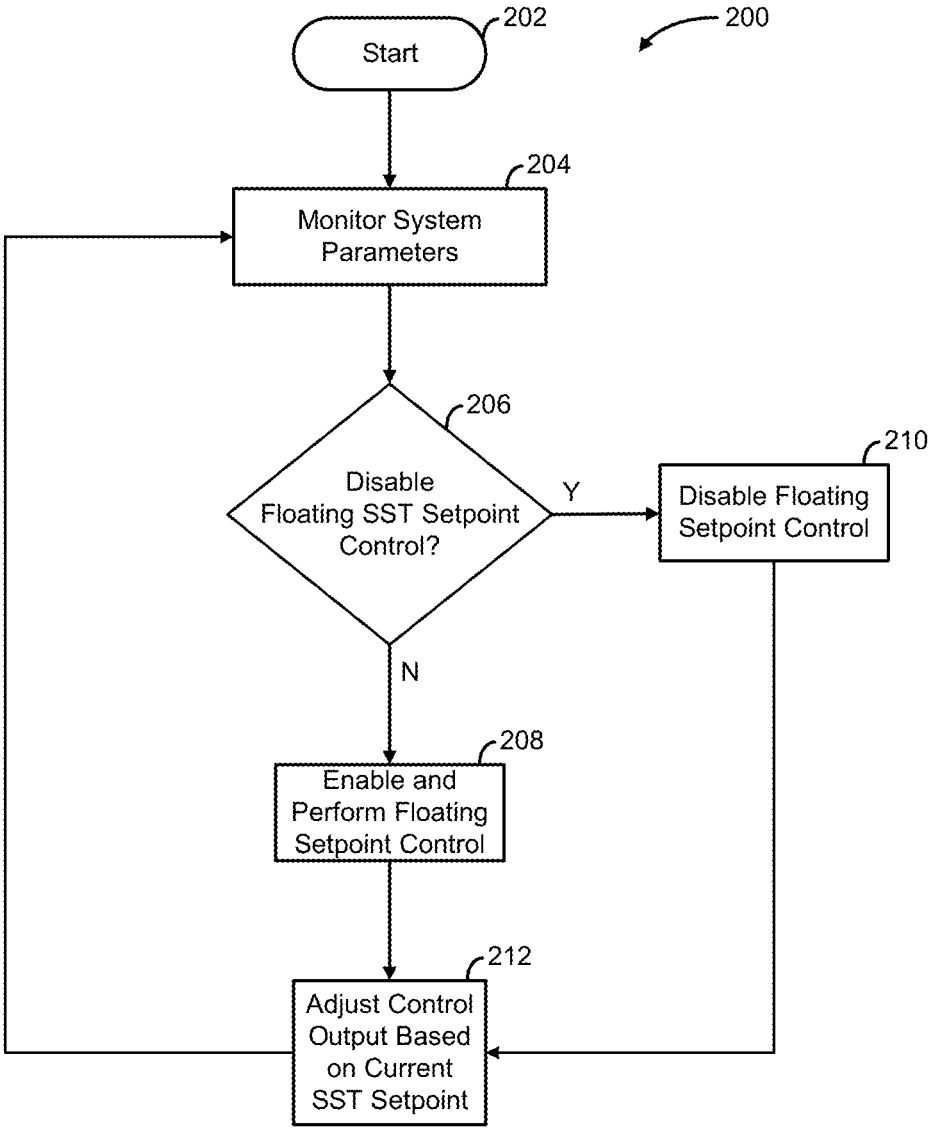
FIG. 2 is a flowchart for a control algorithm in accordance with the present teachings.

With reference to FIG. 2, a flowchart for a control algorithm 200 in accordance with the present teachings is shown. The control algorithm 200 can be executed, for example, by the case controller 26 or another suitable controller. As noted in FIG. 2, the control algorithm 200 shown in FIG. 2 is a high-level process overview of the control algorithm 200 executed by the case controller and starts at 202. At 204, the case controller 26 monitors system parameters of the refrigeration system 10, such as the DAT sensed by the DAT sensor 28 and the evaporator suction pressure sensed by the suction pressure sensor 30. Additionally, the case controller 26 can monitor data received from other controllers associated with the refrigeration system 10, such as a system controller. Based on the monitored data, the case controller 26 can determine whether the refrigeration system 10 is currently in a pulldown state after a defrost cycle. For example, the case controller 26 can monitor the system parameters, such as the DAT of the evaporator 20 and the evaporation suction pressure and determine that the evaporator 20 is in a pulldown state associated with quickly lowering a temperature of the case 22 after a defrost cycle. Additionally or alternatively, the case controller 26 can receive data from other controllers associated with the system indicating that the evaporator 20 is in a pulldown state after a defrost cycle.

At 206, the case controller 26 determines whether to disable floating SST setpoint control. When floating SST setpoint control is enabled, the case controller 26 can increase or decrease the current SST setpoint to adjust the SST setpoint in accordance with the present disclosure. When floating SST setpoint control is disabled, the case controller 26 simply uses the most recent SST setpoint stored in memory 28. At 206, based on the monitored system parameters, the case controller 26 determines whether to enable or disable floating SST setpoint control. For example, if the case controller 26 determines that the evaporator 20 is currently in a pulldown state after a defrost cycle, the case controller 26 disables floating SST setpoint control, at least for a predetermined period of time. If the case controller 26 determines that the evaporator 20 is not currently in a pulldown state after a defrost cycle and is, instead, in a normal refrigeration state, the case controller 26 enables floating SST setpoint control. At 206, when the case controller 26 enables floating setpoint control, the case controller 26 proceeds to 208. When the case controller 26 disables floating setpoint control, the case controller 26 proceeds to 210.

At 210, when floating setpoint control is disabled, the case controller 26 retrieves and sets the current SST setpoint to the most recent SST setpoint stored in memory 28 and proceeds to 212.

At 208, when floating setpoint control is enabled, the case controller performs floating setpoint control and adjusts the current SST setpoint, as discussed in further detail with reference to FIGS. 3 to 5. The case controller 26 then proceeds to 212.

At 212, the case controller 26 adjusts the control output based on the current SST setpoint. As discussed in further detail below with reference to FIG. 6, the case controller 26 compares the current SST setpoint with the current evaporator SST, as determined based on the sensed evaporator suction pressure sensed by pressure sensor 30, and adjusts the EEPR 24 accordingly based on the comparison. The case controller 26 then loops back to 204 and continues to monitor system parameters of the refrigeration system 10.

Figure 3:
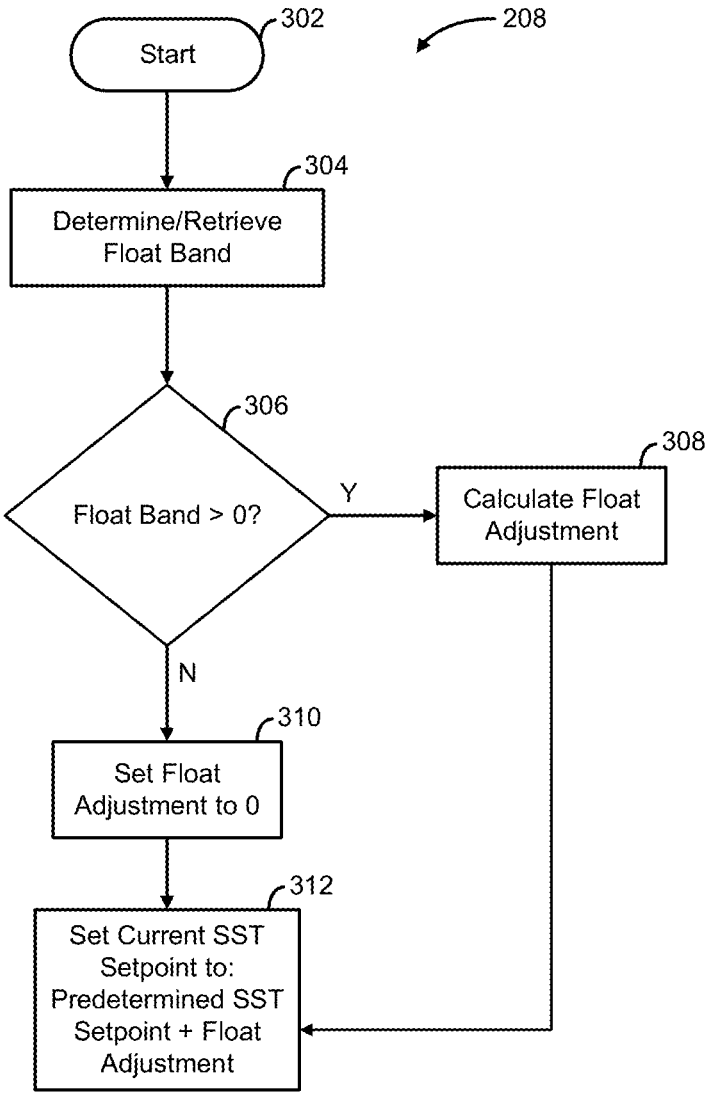
FIG. 3 is a flowchart for a control algorithm for performing floating setpoint control in accordance with the present teachings.

With reference to FIG. 3, a flowchart for a control algorithm 208 in accordance with the present teachings is shown. The functionality of the control algorithm 208 shown in FIG. 3 corresponds to the functionality encapsulated in box 208 of FIG. 2 for performing floating setpoint control. The control algorithm 208 is performed by the case controller 26 and starts at 302. At 304, the case controller 26 determines and/or retrieves an SST float band parameter. The SST float band parameter can be stored in memory 28 and corresponds to a temperature range within which the SST can float, using an initial predetermined SST setpoint as a starting point. The initial predetermined SST setpoint is user configurable. For example, the initial predetermined SST setpoint can be set to correspond to the SST setpoint recommended by the manufacturer of the associated case 22 or evaporator 20. The manufacturer of the associated case 22 or evaporator 20 can, for example, determine and indicate a recommended SST setpoint for the particular case 22 or evaporator 20 based on equipment specifications and recommended operating conditions and the end user or installer can set the initial predetermined SST setpoint to correspond to that recommended SST. The SST float band parameter is a stored temperature range used to determine the temperature range within which the SST will be adjusted. For example, if the recommended or predetermined SST setpoint is X degrees, the float band parameter may indicate a temperature range of 6 degrees. In such case, the SST can float or be adjusted within a range of X−3 degrees to X+3 degrees. Similarly, if the float band parameter is 8 degrees, the SST can float or be adjusted within a range of X−4 degrees to X+4 degrees. The SST float band parameter can be user configurable and set by a user or installer of the case 22, evaporator 20, and/or refrigeration system 10. For example, the case controller 26 may include a user input/output interface that enables a user or technician to set system parameters, such as the SST float band parameter. In the event the user or technician would like to effectively disable the floating setpoint control functionality, the user or technician can set the SST float band parameter to 0 degrees. In that case, the SST setpoint will be adjusted and the case controller 26 will simply use the initial or predetermined SST setpoint, as discussed in further detail below.

After determining or retrieving the SST float band parameter at 304, the case controller 26 proceeds to 306 and determines whether the float band parameter is greater than 0. As mentioned above, the float band parameter can be set to 0 degrees to disable floating SST setpoint control functionality. At 306, when the float band parameter is greater than 0 degrees, the case controller proceeds to 308 and calculates an SST float adjustment value, as discussed in further detail with reference to FIGS. 4 and 5 below. The case controller then proceeds to 312. At 306, when the float band parameter is not greater than 0, the case controller 26 proceeds to 310 and sets the SST float adjustment value to 0.

The case controller 26 then proceeds to 312 and sets the current SST setpoint to be the initial or predetermined SST setpoint plus the SST float adjustment value set at either 308 or 310. For example, if the recommended or predetermined SST setpoint is X degrees, and the float adjustment is set to 0 degrees at 310, the current SST setpoint is set to X degrees at 312. Likewise, if the float adjustment was set to 0.5 degrees at 308, then the current SST setpoint is set to X+0.5 degrees at 312. Similarly, if the float adjustment was set to −0.25 degrees at 308, then the current SST setpoint is set to X—0.25 degrees at 312.

With additional reference to FIG. 2, the case controller would then use the current SST setpoint set at 312 of FIG. 3 to adjust the control output at 212 of FIG. 2.

Figure 4:
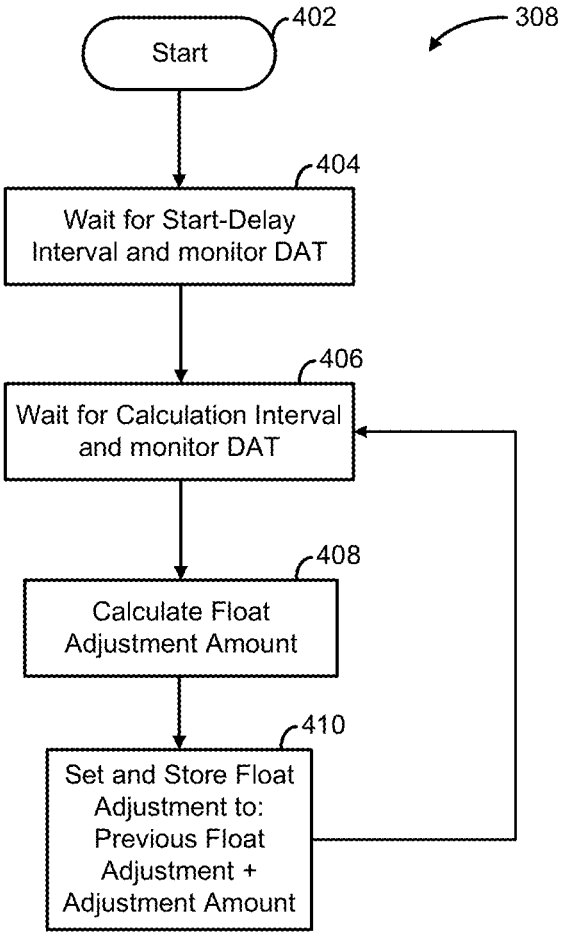
FIG. 4 is a flowchart for a control algorithm for calculating a float adjustment in accordance with the present teachings.

With reference to FIG. 4, a flowchart for a control algorithm 308 in accordance with the present teachings is shown. The functionality of the control algorithm 308 shown in FIG. 4 corresponds to the functionality encapsulated in box 308 of FIG. 3 for calculating the SST float adjustment value. The control algorithm 308 is performed by the case controller 26 and starts at 402. At 404, the case controller 26 initially waits for a start-delay interval and monitors the DAT of the evaporator 20 over that time period. For example, when the floating SST setpoint control is enabled and performed for the first time, the start-delay interval allows the control algorithm 308 to collect a sufficient amount of DAT data before making adjustments to the SST setpoint. The start-delay interval can be, for example, 10 to 30 minutes and can be user configurable. Additionally, the start-delay interval can be user configurable within a predetermined range of time periods having a maximum and a minimum time period.

After collecting DAT data during the start-delay interval, the case controller 26 proceeds to 406 and waits for a calculation interval while monitoring DAT data. The calculation interval is the normal loop time of the control algorithm 308 and can be, for example, set to 5 to 10 minutes. The calculation interval can be user configurable. Additionally, the calculation interval can be user configurable within a predetermined range of time periods having a maximum and a minimum time period.

After collecting DAT data during the calculation interval, the case controller proceeds to 408 and calculates and stores a current float adjustment amount, as described in further detail below with reference to FIG. 5. After calculating and storing the float adjustment amount, the case controller proceeds to 410.

At 410, the case controller sets the float adjustment to be the previous float adjustment plus the adjustment amount calculated at 408. The case controller then loops back to 406 and continues to monitor DAT data during the next calculation interval.

Figure 5:
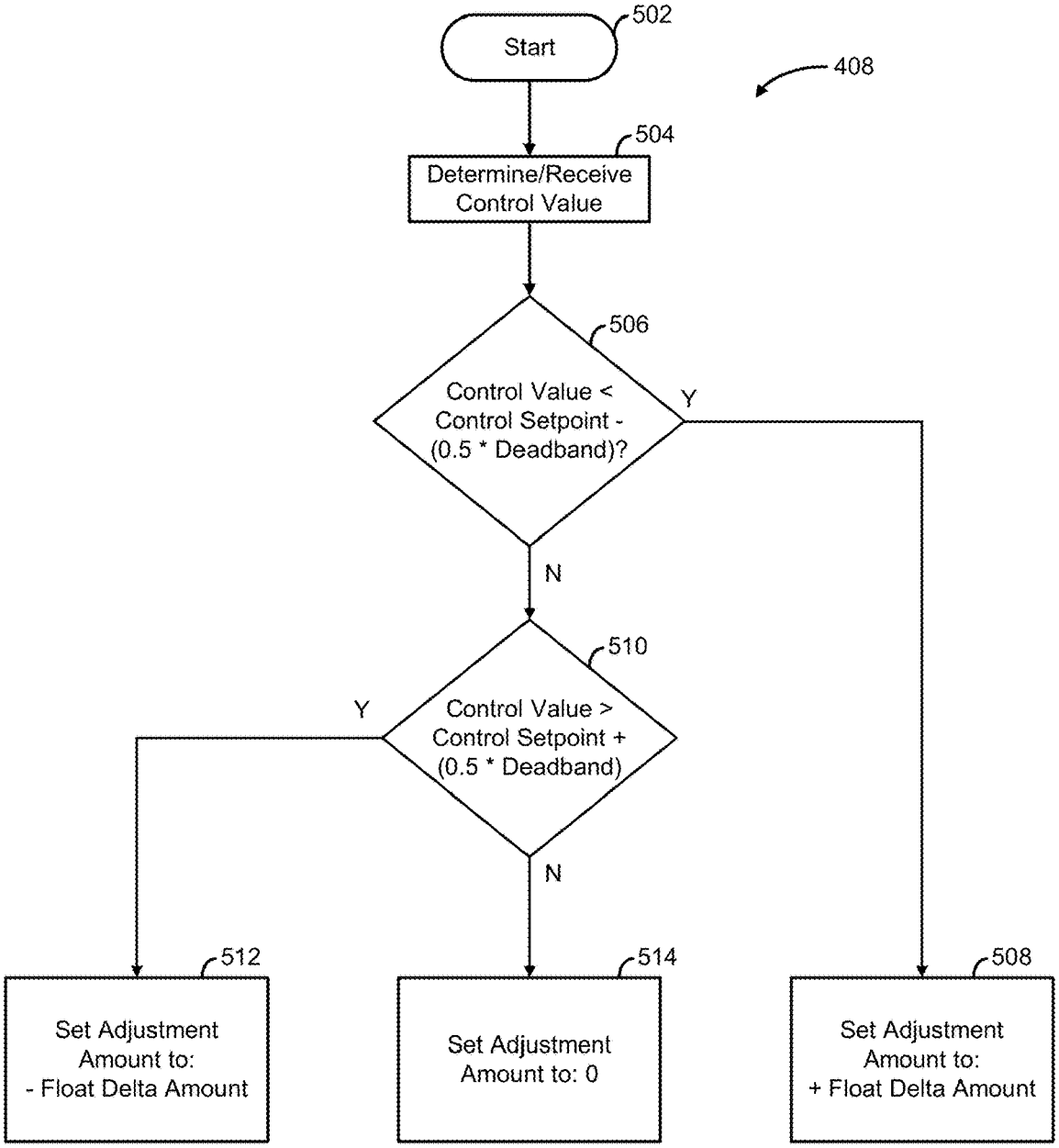
FIG. 5 is a flowchart for a control algorithm for calculating an adjustment amount in accordance with the present teachings.

With reference to FIG. 5, a flowchart for a control algorithm 408 in accordance with the present teachings is shown. The functionality of the control algorithm 408 shown in FIG. 5 corresponds to the functionality encapsulated in box 408 of FIG. 4 for calculating the adjustment amount. The control algorithm 408 is performed by the case controller 26 and starts at 502. At 504, the case controller 26 determines or receives the current control value. For example, the control value can be based on the collected DAT data. For example, the control value can be an average DAT over a predetermined time period, such as a moving 60 minute time period. While 60 minutes is given as an example, any time period can be used. In addition, as mentioned above, while DAT data is used in the current example, other types of data can alternatively be used in accordance with the present disclosure. For example, evaporator return air temperature (RAT) could be used in place of or in addition to DAT data. Additionally or alternatively, instead of using an average of DAT over a time period, the control value can correspond to a minimum or maximum DAT during the time period. Additionally or alternatively, DAT data could be averaged from different cases 22 and/or evaporators 20. In such case, the case controllers 26 can communicate with each other to calculate and determine the control value. After determining or receiving the control value at 504, the case controller 26 proceeds to 506.

At 506, the case controller 26 compares the control value with a temperature range around a control setpoint based on a control setpoint deadband. For example, using the example of average DAT over a time period as the control value, the control setpoint corresponds to a target DAT for the case 22 or evaporator 20. For example, the DAT control setpoint can be set to 40° Fahrenheit and the control deadband can be 2°, resulting in a temperature range of +/−1° from the 40° control setpoint temperature. In other words, the resulting temperature range is +/−half of the control deadband from the control setpoint temperature. In this way, the resulting temperature range spans from an upper temperature of the control setpoint plus half of the control deadband to a lower temperature of the control setpoint minus half of the control deadband. The control setpoint and the control deadband can both be user configurable. At 506 the case controller 26 compares the control value, e.g., an average DAT value, with the lower end of the temperature range, i.e., the control setpoint minus half of the control deadband. Using the above example of a 40° control setpoint and a control deadband of 2°, the lower end of the temperature range would be 39° (i.e., 40°−1°=39°). At 506, when the control value is less than the control set point minus the half of the deadband, the case controller 26 proceeds to 508. At 508, because the control value is below the control setpoint minus half of the dead band, the DAT is too low and the case controller 26 sets the adjustment amount to be a positive float delta amount. The float delta amount can be, for example, 0.2°. The float delta amount can be user configurable. In this way, at 508, the case controller 26 sets the adjustment amount to be the positive float delta amount, i.e., positive 0.2. With reference back to 410 of FIG. 4, the float adjustment would be set to the previous float adjustment plus the float delta amount, i.e., the previous float adjustment plus 0.2. In this way, at 508 when the control value, such as DAT, is too low, the float adjustment is increased, thereby causing the DAT to incrementally increase. At 506 when the control value is not less than the control setpoint minus half of the deadband, the case controller 26 proceeds to 510.

At 510, the case controller 26 compares the control value with the control setpoint plus the half of the deadband amount. Using the above example, if the control setpoint is 40° Fahrenheit and the control deadband is 2°, at 510, the case controller 26 determines whether the control value is greater than 41° (i.e., 40°+1°=41°). At 510, when the control value is greater than the control setpoint plus half of the deadband, the case controller proceeds to 512 and sets the adjustment amount to be negative float adjustment amount. At 512, because the control value is above the control setpoint plus half of the deadband, the DAT is too high and the case controller 26 sets the adjustment amount to be a negative float delta amount. Using a float delta amount of 0.2°, for example, at 512, the case controller 26 sets the adjustment amount to be the negative float delta amount, i.e., −0.2. With reference back to 410 of FIG. 4, the float adjustment would be set to the previous float adjustment minus the float delta amount, i.e., the previous float adjustment minus 0.2. In this way, at 512 when the control value, such as DAT, is too high, the float adjustment is decreased, thereby causing the DAT to incrementally decrease. At 510 when the control value is not greater than the control value plus half of the deadband, the case controller 26 proceeds to 514.

At 514, the case controller 26 has determined that the control value, e.g., DAT, is within the deadband of the control value. In other words, the control value is close to the target control setpoint. In the above example, in this case the control value DAT would be within +/−1° of the control setpoint of 40°. In this case, at 514 the case controller 26 sets the adjustment amount to 0 and no change to the float adjustment is made at 410 of FIG. 4.

Figure 6:
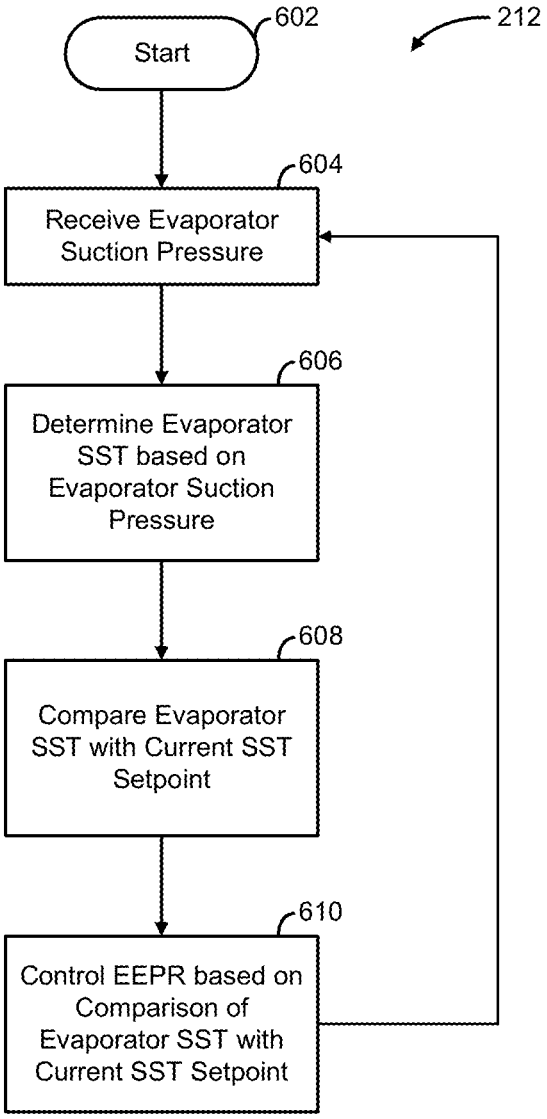
FIG. 6 is a flowchart for a control algorithm for adjusting a control output.

With reference to FIG. 6, a flowchart for a control algorithm 212 in accordance with the present teachings is shown. The functionality of the control algorithm 212 shown in FIG. 6 corresponds to the functionality encapsulated in box 212 of FIG. 2 for calculating the adjustment amount. The control algorithm 408 is performed by the case controller 26 and starts at 602. At 604, the case controller 26 receives the current evaporator suction pressure from the evaporator suction pressure sensor 30. At 606, the case controller 26 determines evaporator SST based on the sensed evaporator suction pressure. As known in the art, evaporator SST can be readily calculated from evaporator suction pressure. As an example, the National Institute of Standards and Technology (NIST) maintains and provides a database referred to as the NIST Reference Fluid Thermodynamic and Transport Properties Database (REFPROP), which is currently at Version 10. The REFPROP Database includes data for readily converting evaporator suction pressure to evaporator SST. The REFPROP database is available for download at NIST's website (nist.gov/srd/ref prop). After determining evaporator SST, the case controller 26 proceeds to 608.

At 608, the case controller 26 compares the determined evaporator SST with the current SST setpoint. At 610, the case controller 26 controls the EEPR 24 based on the comparison of evaporator SST with the current SST setpoint performed at 608. For example, the case controller 26 can use a PID algorithm, for example, to control the EEPR 24 based on the comparison. Generally, when evaporator SST is greater than the current SST setpoint, the case controller 26 can increase the opening of the EEPR to lower the evaporator SST and can decrease the opening of the EEPR to increase the evaporator SST.

The case controller 26 then loops back to 604 and continues to receive evaporator suction pressure from the evaporator suction pressure sensor 30.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements.

As used herein, the phrase at least one of A and B should be construed to mean a logical (A OR B), using a non-exclusive logical OR. For example, the phrase at least one of A and B should be construed to include any one of: (i) A alone; (ii) B alone; (iii) both A and B together. The phrase at least one of A and B should not be construed to mean "at least one of A and at least one of B." The phrase at least one of A and B should also not be construed to mean "A alone, B alone, but not both A and B together." The term "subset" does not necessarily require a proper subset. In other words, a first subset of a first set may be coextensive with, and equal to, the first set.

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" or the term "controller" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module or controller may include one or more interface circuits. In some examples, the interface circuit(s) may implement wired or wireless interfaces that connect to a local area network (LAN) or a wireless personal area network (WPAN). Examples of a LAN are Institute of Electrical and Electronics Engineers (IEEE) Standard 802.11-2016 (also known as the WIFI wireless networking standard) and IEEE Standard 802.3-2015 (also known as the ETHERNET wired networking standard). Examples of a WPAN are the BLUETOOTH wireless networking standard from the Bluetooth Special Interest Group and IEEE Standard 802.15.4. In addition, components, controllers, and programmable logic controllers of the present disclosure can communicate with a network using an RS-485 communication protocol, a Modbus communication protocol, a BACnet communication protocol, an Ethernet communication protocol.

The module or controller may communicate with other modules or controllers using the interface circuit(s). Although the module or controller may be depicted in the present disclosure as logically communicating directly with other modules or controllers, in various implementations the module or controller may actually communicate via a communications system. The communications system includes physical and/or virtual networking equipment such as hubs, switches, routers, and gateways. In some implementations, the communications system connects to or traverses a wide area network (WAN) such as the Internet. For example, the communications system may include multiple LANs connected to each other over the Internet or point-to-point leased lines using technologies including Multiprotocol Label Switching (MPLS) and virtual private networks (VPNs).

In various implementations, the functionality of the module or controller may be distributed among multiple modules or controllers that are connected via the communications system. For example, multiple modules or controllers may implement the same functionality distributed by a load balancing system. In a further example, the functionality of the module or controller may be split between a server (also known as remote, or cloud) module and a client (or, user) module.

Some or all hardware features of a module or controller may be defined using a language for hardware description, such as IEEE Standard 1364-2005 (commonly called "Verilog") and IEEE Standard 1076-2008 (commonly called "VHDL"). The hardware description language may be used to manufacture and/or program a hardware circuit. In some implementations, some or all features of a module may be defined by a language, such as IEEE 1666-2005 (commonly called "SystemC"), that encompasses both code, as described below, and hardware description.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The systems and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Swift, Haskell, Go, SQL, R, Lisp, Java®, Fortran, Perl, Pascal, Curl, OCaml, JavaScript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, Python®, and/or IEC 61131-3 languages.

What is claimed is:

1. A system comprising:

a case controller for a refrigeration case of a refrigeration system, the case controller being configured to:

determine an evaporator saturated suction temperature (SST) of an evaporator of the refrigeration case;

control an evaporator pressure regulator of the refrigeration system based on a comparison of the evaporator SST with an evaporator saturated suction temperature (SST) setpoint;

receive an air temperature value from an air temperature sensor associated with the refrigeration case;

determine whether the air temperature value is within a predetermined range of an air temperature setpoint;

adjust the SST setpoint in response to the air temperature value being outside of the predetermined range of the air temperature setpoint;

increase the SST setpoint in response to the air temperature value being outside of the predetermined range and below the air temperature setpoint; and decrease the SST setpoint in response to the air temperature value being outside of the predetermined range and above the air temperature setpoint.

2. The system of claim 1, wherein the air temperature sensor monitors at least one of a discharge air temperature (DAT) value and a return air temperature (RAT) value of the evaporator and communicates the at least one of the DAT value and the RAT value to the case controller as the air temperature value.

3. The system of claim 1, wherein the case controller is further configured to adjust the SST setpoint a maximum of one time during each of consecutive predetermined time interval cycles based on an adjustment amount.

4. The system of claim 3, wherein the adjustment amount is user configurable.

5. The system of claim 1, wherein the case controller is further configured to:

receive an evaporator suction pressure from an evaporator suction pressure sensor associated with the evaporator;

determine the evaporator SST of the evaporator based on the evaporator suction pressure;

compare the evaporator SST with the evaporator SST setpoint; and control the evaporator pressure regulator based on the comparison of the evaporator SST with the evaporator SST setpoint.

6. The system of claim 5, wherein the case controller is further configured to increase an opening of the evaporator pressure regulator when the evaporator SST is greater than the evaporator SST setpoint and to decrease the opening of the evaporator pressure regulator when the evaporator SST is less than the evaporator SST setpoint.

7. The system of claim 1, wherein the evaporator pressure regulator is an electronic evaporator pressure regulator.

8. A method comprising:

determining, with a case controller for a refrigeration case of a refrigeration system, an evaporator saturated suction temperature (SST) of an evaporator of the refrigeration case;

controlling, with the case controller, an evaporator pressure regulator of the refrigeration system based on a comparison of the evaporator SST with an evaporator saturated suction temperature (SST) setpoint;

receiving, with the case controller, an air temperature value from an air temperature sensor associated with the refrigeration case;

determining, with the case controller, whether the air temperature value is within a predetermined range of an air temperature setpoint;

adjusting, with the case controller, the SST setpoint in response to the air temperature value being outside of the predetermined range of the air temperature setpoint;

increasing, with the case controller, the SST setpoint in response to the air temperature value being outside of the predetermined range and below the air temperature setpoint; and decreasing, with the case controller, the SST setpoint in response to the air temperature value being outside of the predetermined range and above the air temperature setpoint.

9. The method of claim 8, wherein the air temperature sensor monitors at least one of a discharge air temperature (DAT) value and a return air temperature (RAT) value of the evaporator and communicates the at least one of the DAT value and the RAT value to the case controller as the air temperature value.

10. The method of claim 8, further comprising:

adjusting, with the case controller, the SST setpoint a maximum of one time during each of consecutive predetermined time interval cycles based on an adjustment amount.

11. The method of claim 10, wherein the adjustment amount is user configurable.

12. The method of claim 8, further comprising:

receiving, with the case controller, an evaporator suction pressure from an evaporator suction pressure sensor associated with the evaporator;

determining, with the case controller, an evaporator SST of the evaporator based on the evaporator suction pressure;

comparing, with the case controller, the evaporator SST with the evaporator SST setpoint; and controlling, with the case controller, the evaporator pressure regulator based on the comparison of the evaporator SST with the evaporator SST setpoint.

13. The method of claim 12, further comprising:

increasing, with the case controller, an opening of the evaporator pressure regulator when the evaporator SST is greater than the evaporator SST setpoint; and decreasing, with the case controller, the opening of the evaporator pressure regulator when the evaporator SST is less than the evaporator SST setpoint.

14. The method of claim 8, wherein the evaporator pressure regulator is an electronic evaporator pressure regulator.

15. A system comprising:

a case controller for a refrigeration case of a refrigeration system, the case controller being configured to:

determine an evaporator saturated suction temperature (SST) of an evaporator of the refrigeration case;

control an evaporator pressure regulator of the refrigeration system based on a comparison of the evaporator SST with an evaporator saturated suction temperature (SST) setpoint;

receive an air temperature value from an air temperature sensor associated with the refrigeration case;

determine whether the air temperature value is within a predetermined range of an air temperature setpoint; and adjust the SST setpoint in response to the air temperature value being outside of the predetermined range of the air temperature setpoint;

wherein the air temperature sensor monitors at least one of a discharge air temperature (DAT) value and a return air temperature (RAT) value of the evaporator and communicates the at least one of the DAT value and the RAT value to the case controller as the air temperature value.

16. The system of claim 15, wherein the case controller is further configured to adjust the SST setpoint a maximum of one time during each of consecutive predetermined time interval cycles based on an adjustment amount.

17. The system of claim 16, wherein the adjustment amount is user configurable.

18. The system of claim 15, wherein the case controller is further configured to:

receive an evaporator suction pressure from an evaporator suction pressure sensor associated with the evaporator;

determine the evaporator SST of the evaporator based on the evaporator suction pressure;

compare the evaporator SST with the evaporator SST setpoint; and control the evaporator pressure regulator based on the comparison of the evaporator SST with the evaporator SST setpoint.

19. The system of claim 18, wherein the case controller is further configured to increase an opening of the evaporator pressure regulator when the evaporator SST is greater than the evaporator SST setpoint and to decrease the opening of the evaporator pressure regulator when the evaporator SST is less than the evaporator SST setpoint.

20. The system of claim 15, wherein the evaporator pressure regulator is an electronic evaporator pressure regulator.

* * * * *